US008820227B2

(12) United States Patent
Reimann et al.

(10) Patent No.: US 8,820,227 B2
(45) Date of Patent: Sep. 2, 2014

(54) STRAPPING MACHINE FOR TYING PACKAGES, IN PARTICULAR METAL STRIPS WOUND INTO COILS

(75) Inventors: Ralf Reimann, Menden (DE); Andreas Pieper, Werne (DE); Karl Robert Hofmann, Netphen (DE)

(73) Assignee: SMS Logistiksysteme GmbH, Nelphen (DE)

( * ) Notice: Subject to any disclaimer, the term of this patent is extended or adjusted under 35 U.S.C. 154(b) by 198 days.

(21) Appl. No.: 13/390,966

(22) PCT Filed: Oct. 8, 2010

(86) PCT No.: PCT/EP2010/006145

§ 371 (c)(1),
(2), (4) Date: Feb. 27, 2012

(87) PCT Pub. No.: WO2011/042191

PCT Pub. Date: Apr. 14, 2011

(65) Prior Publication Data

US 2012/0186464 A1 Jul. 26, 2012

(30) Foreign Application Priority Data

Oct. 10, 2009 (DE) ..... 10 2009 048 943

(51) Int. Cl.

| | |
|---|---|
| ***B65B 13/32*** | (2006.01) |
| ***B65B 27/06*** | (2006.01) |
| ***B65B 13/06*** | (2006.01) |

(52) U.S. Cl.

CPC ..... *B65B 13/32* (2013.01); *B65B 27/06* (2013.01); *B65B 13/06* (2013.01)

USPC ..... 100/33 R

(58) Field of Classification Search

USPC ..... 100/8, 26, 27, 29, 33 R, 33 PB; 53/589; 156/391, 580, 580.1; 219/86.1, 56, 57, 219/91.21

See application file for complete search history.

(56) References Cited

U.S. PATENT DOCUMENTS

| | | | | |
|---|---|---|---|---|
| 2,614,487 | A * | 10/1952 | Cheesman | 100/27 |
| 3,674,972 | A * | 7/1972 | Stahnke | 219/56 |
| 4,244,773 | A | 1/1981 | Siebeck | |
| 4,689,938 | A | 9/1987 | Zoppa | |
| 7,681,496 | B2 * | 3/2010 | Takidis et al. | 100/33 R |

* cited by examiner

*Primary Examiner* — Jimmy T Nguyen
(74) *Attorney, Agent, or Firm* — Andrew Wilford

(57) ABSTRACT

A strapping machine for securing at least one strap around a package has a binding head engageable against the package, a cincher, and a welder for connecting ends of the tightened strap. The welder has at least one upper advanceable welding electrode in an electrode housing and a counter electrode temporarily interacting therewith. A slide plate movable toward the package, forms the counter electrode, engages underneath overlapping ends of the strapping and directly on the package, and has a projecting tongue spaced from the welding electrode and a plate end part connected to a positioning mechanism.

9 Claims, 6 Drawing Sheets

STRAPPING MACHINE FOR TYING PACKAGES, IN PARTICULAR METAL STRIPS WOUND INTO COILS

CROSS REFERENCE TO RELATED APPLICATIONS

This application is the US-national stage of PCT application PCT/EP2010/006145 filed 8 Oct. 2010, published 14 Apr. 2011 as WO2011/042191, and claiming the priority of German patent application 102009048943.6 itself filed 10 Oct. 2009.

FIELD OF THE INVENTION

The invention relates to a strapping machine for securing at least one strap around a package, in particular a coil of metal strip, comprising a binding head engageable against the package, a cincher, and a welder for connecting ends of the tightened strap and having at least one upper advanceable welding electrode in an electrode housing and a counter electrode temporarily interacting therewith, the welder being movable toward the package on a slide plate.

BACKGROUND OF THE INVENTION

The basic principle of such strapping machines from the prior art in various embodiments is based on positioning a binding head or a strapping or closure head on a package that is to be strapped, to guide strapping around the package, to tighten or cinch the strapping and to connect its ends one behind the other inside the binding head. The overlapping ends of the prestressed strap are connected to one another by adhesive force or in another positive manner. The strapping pulled off a supply reel is cut and the binding head is lifted from the package, these steps all being carried out in an automated manner.

A strapping machine of this type with a cincher and closure device of the type mentioned above is known from EP 10194627 [U.S. Pat. No. 4,689,938]. The slide plate that can be moved with the counter electrode like a carriage in the plane of the overlapping region below the welding electrodes is formed by an upper plate and a lower plate that slide against one another or over one another. The upper plate is thus guided on the lower slide plate in which the counter electrode is embedded. With the electrodes pressing the strap ends against one another, an electric circuit initiating the welding operation is closed. This happens when the upper plate has been moved so far away that it exposes the counter electrode embedded in the lower plate, with the strapping lying immediately above the counter electrode and below the advanceable welding electrode. After the welding operation, the upper plate then carrying the lower plate along simultaneously is shifted so far that the welded loop of strapping is released and exposed.

During transport of the packages, for example coiled rod-like or tubular metal products or metal strips wound to form coils, the strapping is subject to very great, sometimes dynamic stresses that it has to absorb. Depending on the material quality and material properties of the packages, one to three straps are placed around the outer surface of the packages to secure it against bursting open and/or to prevent displacement. In any case the strapping must be strongly prestressed, close to the limits of its tensile strength and the breaking strength of the material of the strapping, which can lead to strap impressions on the package.

These problems are further intensified by the counter electrode embedded in the steel slider according to the prior art. The slide plate guided in a groove of a mounting plate must be fairly large, in particular in terms of thickness, in order to be able to absorb the considerable forces employed during the welding operation due to the pressure of the welding electrodes. Since the welded strap after cutting and drawing out the steel slide plate with the embedded counter electrode in the closure region or overlapping region according to the thickness of the slide plate includes the additional height due to the groove guidance snaps back to the outer surface of the package, the strap bearing against the surface of the package in a circumferentially closed manner must be additionally prestressed to compensate for this.

OBJECT OF THE INVENTION

The object of the invention is therefore to create an automated strapping machine that in a structurally simpler manner makes possible a secure attachment of strapping that withstands high stresses.

SUMMARY OF THE INVENTION

This object is attained according to the invention in that the slide plate also forms the counter electrode and engages underneath the overlapping ends of the strapping and directly on the package. The slide plate shielding the electrode housing in which, depending on the welding process, the resistance electrodes for welding or tungsten electrodes for inert gas applications are located, during the welding process according to the invention is provided directly between the package and the strapping, so that no current can flow through the package, and itself forms the counter electrode that with the forces occurring makes possible in an advantageous manner support directly on the package, so a much higher strap tension of the strapping can be achieved after the plate is pulled out or removed from the welding region to secure the package with constant tensile force. The distance that the welded strap has to cover during placement on the package is namely determined only by the slight thickness of the slide plate. While the strapping springs back about 10 mm with the known slide plates with an embedded counter electrode and additional guide during placement on the outer surface of the package, with the slide plate according to the invention this dimension is only about 2 mm.

A preferred embodiment of the invention provides that the slide plate has a projecting tongue spaced from the welding electrode and a plate end part connected to a positioning mechanism. There is therefore system separation, which on the one hand makes possible the unimpeded positioning of the projecting tongue relative to the welding electrode or the welding electrodes and, on the other hand, makes possible movement by a pneumatic cylinder unit serving as the positioning mechanism, advantageously for advancing or pushing the welding electrodes, spaced from the location where welding takes place, namely the rear end of the slide plate.

The system separation furthermore opens up the possibility that at least the projecting tongue of the slide plate formed by copper can be made to conform elastically to the surface of the package. The projecting tongue or the slide plate can namely have a small thickness, about 6 mm, since due to the direct support on the package it does not need to absorb any forces, which instead are introduced and absorbed in the binding head housing and/or the chamber-like electrode housing.

The elastic grip can be further promoted by providing the outer edges of the slide plate in the circumferential direction of the package with a curvature or a convexity.

A further advantageous embodiment of the invention lies in that the plate end part carries a cooling block formed with coolant passages and connectable to a coolant supply. The coolant passages can be produced in a simple manner by drilling holes that can be closed by filler plugs when not required for a coolant supply. The cooling block, which can be attached to the plate end part via screws having countersunk heads on the side facing toward the package, guarantees a temperature level that is as constant as possible during the welding operation, so that electrode wear or electrode burnoff is reduced and unnecessary heat transfer into the package is prevented.

Another advantageous embodiment of the invention provides a support frame accommodating the plate end part, which support frame is provided with an orthogonal vertical guide provided with an integrated compression spring means so that the positioning mechanism acts on the vertical guide. The positioning mechanism thus acts indirectly on the slide plate, which can be shifted above the package via the support frame in the binding head housing. The integrated compression spring means is used to return to the starting end position, i.e. after lifting of the welding electrode or the welding electrodes, it brings the slide plate back into its starting position.

According to one proposal of the invention, a downwardly projecting stop bears against the surface of the package, is spaced from the projecting tongue in the adjustment direction, and is provided on the housing of the binding head. This limits the maximum stroke of the slide plate and moreover absorbs forces or transmits them to the binding head housing, which can be a stable welded construction or casting.

If preferably one positioning cylinder acting horizontally on the electrode housing is provided, offset spot welds with a variable spot geometry can be achieved. For example, four, five or six spot welds can be made that with a preferred spot weld diameter or electrode diameter of 6-9 mm should be about 18-30 mm apart in order to avoid current or voltage shorts between the individual spot welds.

According to the invention at least two binding head units with respective slide plates thereto are arranged individually next to one another. This is the system in particular when the strapping necessary for the product requires a dimension that goes beyond a maximum width, commercially usually 32 mm.

BRIEF DESCRIPTION OF THE DRAWING

Further details and features of the invention are shown IN the following description of embodiments of the invention shown in the drawings. Therein.

SPECIFIC DESCRIPTION OF THE INVENTION

Figure 1:
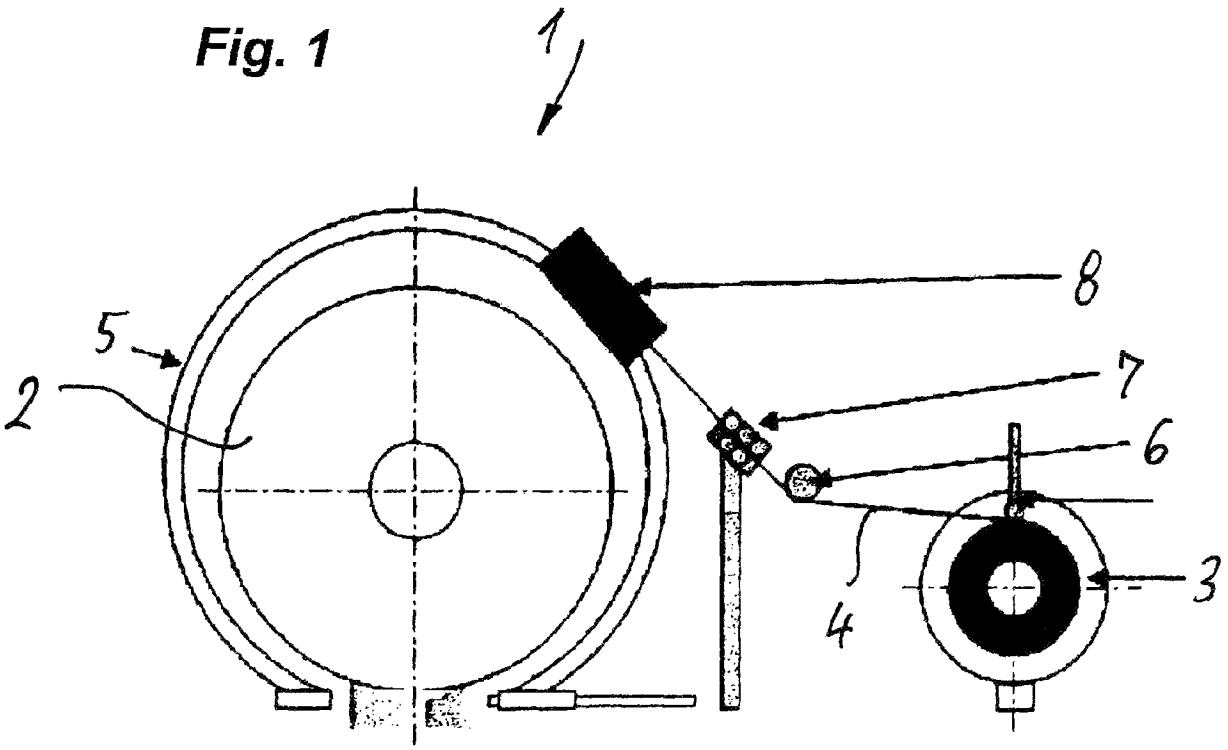
FIG. 1 is a schematic view of a strapping machine.

FIG. 1 shows very diagrammatically a strapping machine 1 for binding a package 2, here a metal-strip coil. Strapping 4 is unwound from a direct coiler 3 with continuous control and brake and conveyed by a strapping guide 5 around the package 2. A deflection roller 6 downstream of the direct coiler guides the strapping 4 first into a roller straightener 7 that ensures that on the one hand the leading end of the strap is conveyed straight and without kinks through the strapping guide 5 up to a binding head 8 and on the other hand the strapping 4 with declining reel radius always extends in a straight line to the strapping guide 5. In the binding head 8 the leading end of the strap is clamped and the excess strap is reversed until the strapping loop is cinched against the outer surface of the package 2. The excess strap is wound up again by reversing the direct coiler 3.

Figure 2:
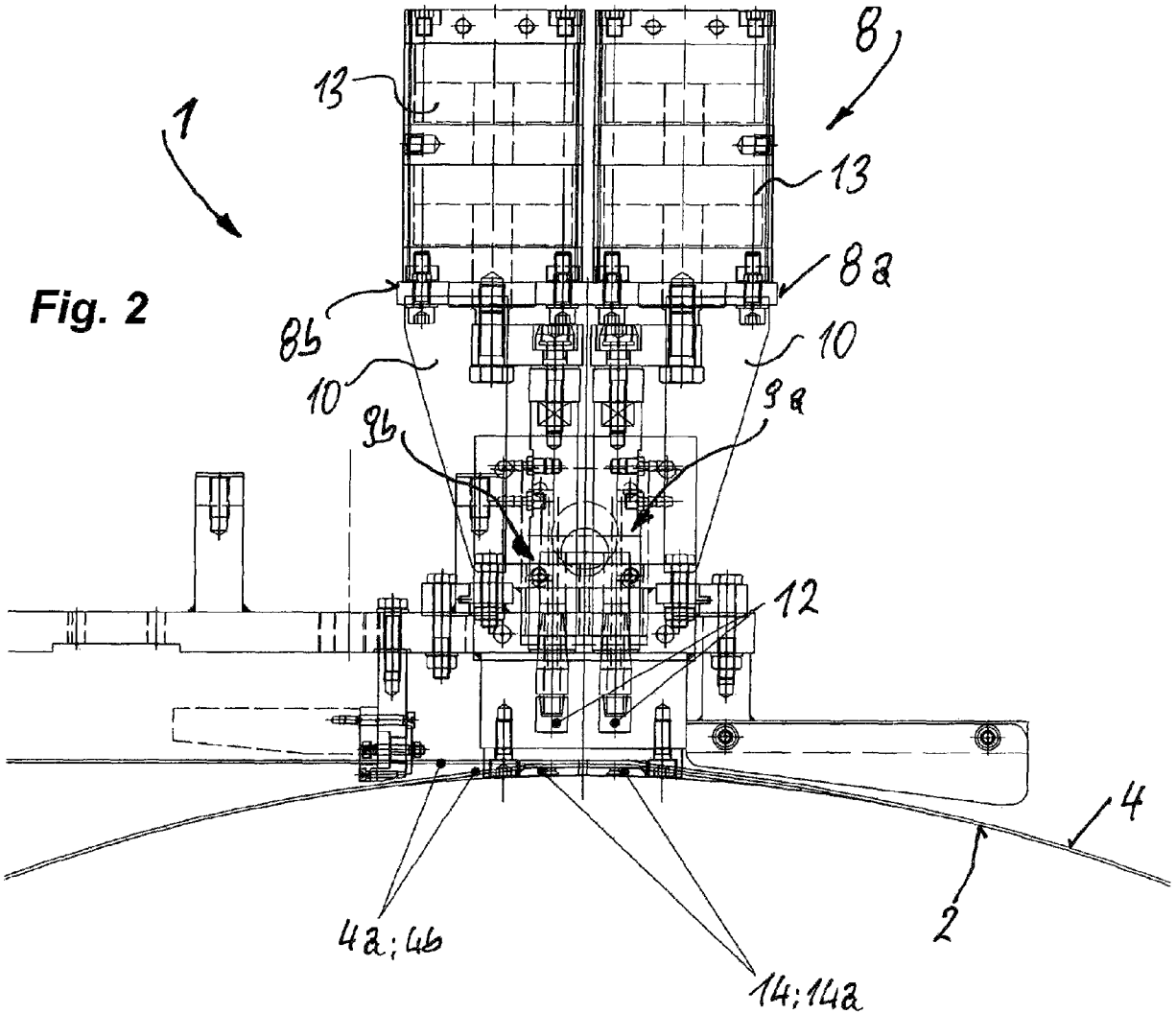
FIG. 2 as a front detail view of a strapping-machine binding unit formed by two binding head units next to one another.

The binding head 8 shown in the embodiment is formed by two binding head units 8*a* and 8*b* next to one another and equipped for connecting the overlapping ends 4*a* and 4*b* of the tightened strap 4 with respective welders 9*a* and 9*b* having respective electrode housings 10 accommodating respective welding electrodes 12 mounted on respective electrode holders 11. The binding head 8 or the binding head units 8*a* and 8*b* and the welding electrodes 12 can be moved against the outer surface of the package 2. To this end the electrode holders 11 are acted on by respective cylinders 13, here pneumatic cylinders, bolted to the electrode housings 10 (see FIGS. 2 and 3).

For welding, slide plates 14 are temporarily positioned opposite the welding electrodes 12. These slide plates are formed of thin copper and, since they are supported or bear directly on the surface of the package 2, also form counter electrodes. As can be seen from FIGS. 3 and 4, each slide plate 14 has a projecting tongue 14*a* and a plate end part 14*b*. For welding, the slide plates 14 can be employed or positioned such that the projecting tongues 14*a* lie opposite the respective welding electrodes 12 in the welding region of the overlapping ends 4*a* and 4*b* of the cinched strapping 4.

Figure 3:
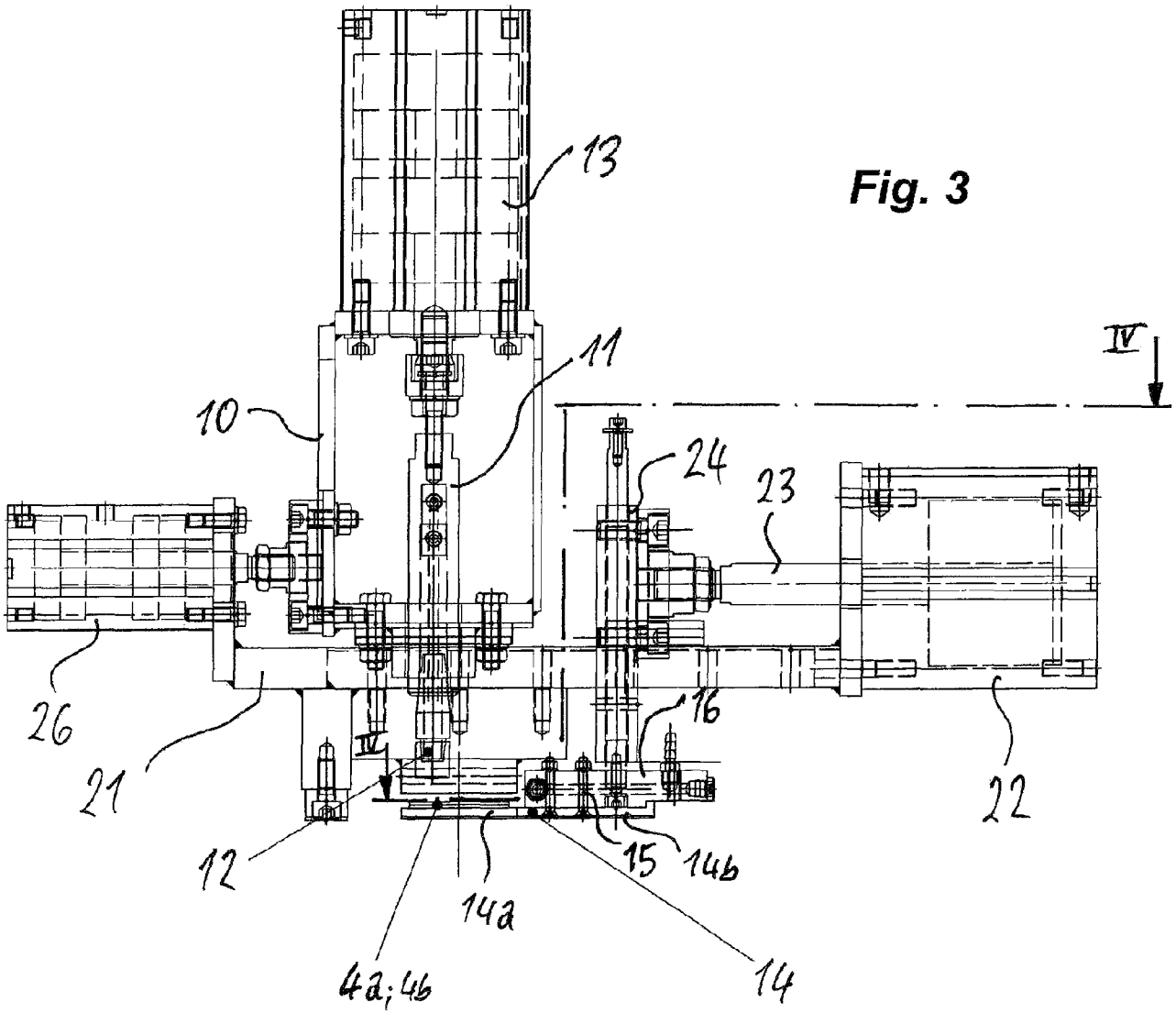
FIG. 3 is a side view of the structure of FIG. 2.
Figure 4:
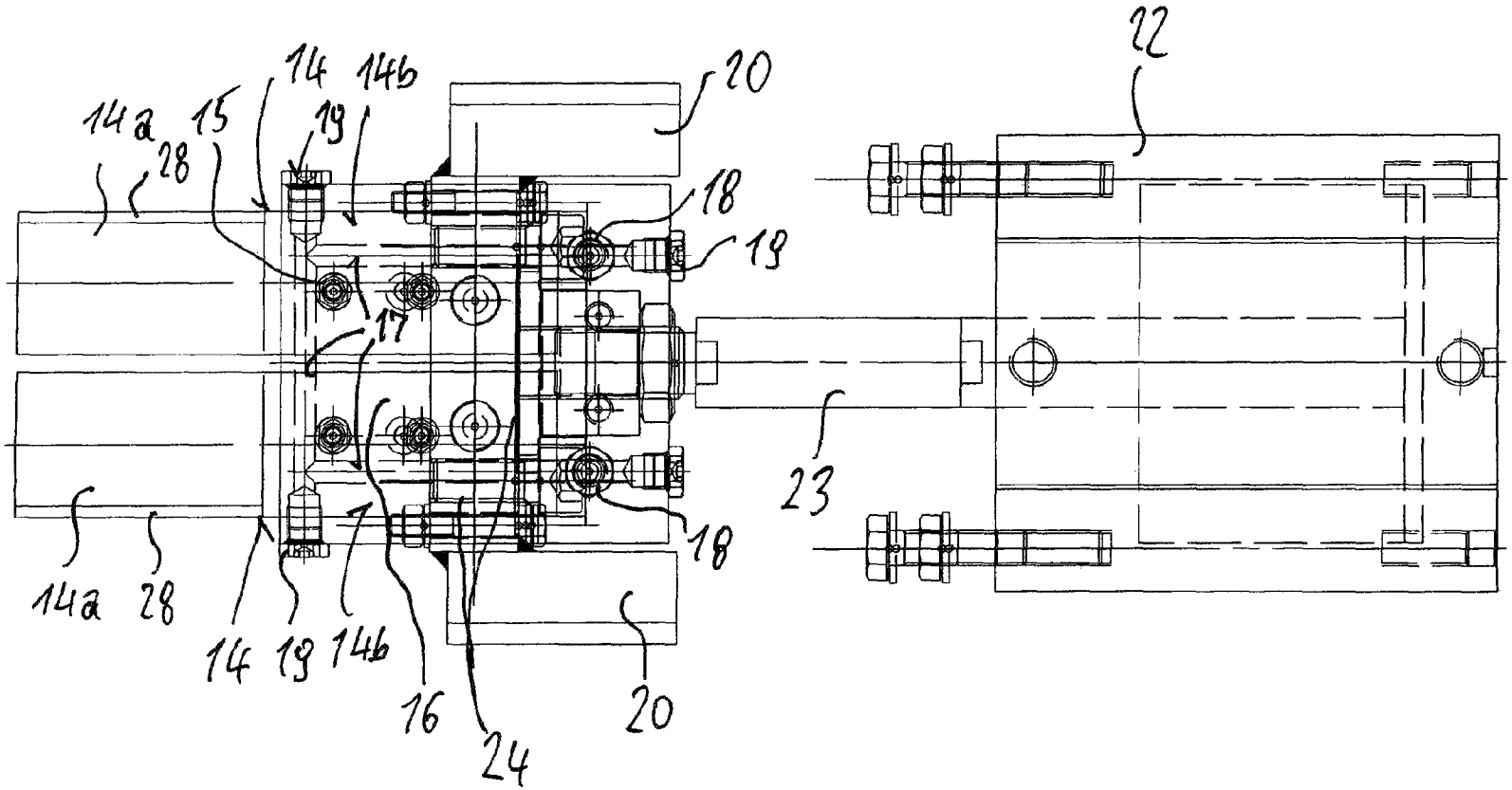
FIG. 4 is a simplified sectional view taken along line IV-IV of FIG. 3.

As can be seen from FIGS. 3 and 4, a cooling block 16 is attached to the plate end parts 14*b* by countersunk headed screws 15. It is provided with coolant passages 17 formed by bores that have connections 18 for the input and output of a coolant (water). The unneeded outlet openings of the bores of the coolant passages 17 are closed by filler plugs 19. The plate end part 14*b* of the slide plate 14 and the cooling block 16 is held by a support frame 20, mounted for straight-line adjustment in a binding head housing 21 (see FIG. 3).

To adjust the support frame 20 and thus to position the slide plate 14, a pneumatic cylinder unit forms a positioning mechanism 22 having a piston rod 23 that acts on a column-like vertical guide 24 extending orthogonally to the support frame 20.

FIG. 3 shows that the binding head housing 21 has an end stop 25 projecting downward and spaced from at a distance opposite the projecting tongue 14*a* of the slide plate 14 and a positioning cylinder 26 acting horizontally on the electrode housing 10. The positioning cylinder 26 makes possible variable, in particular offset, spot welds.

Figure 5:
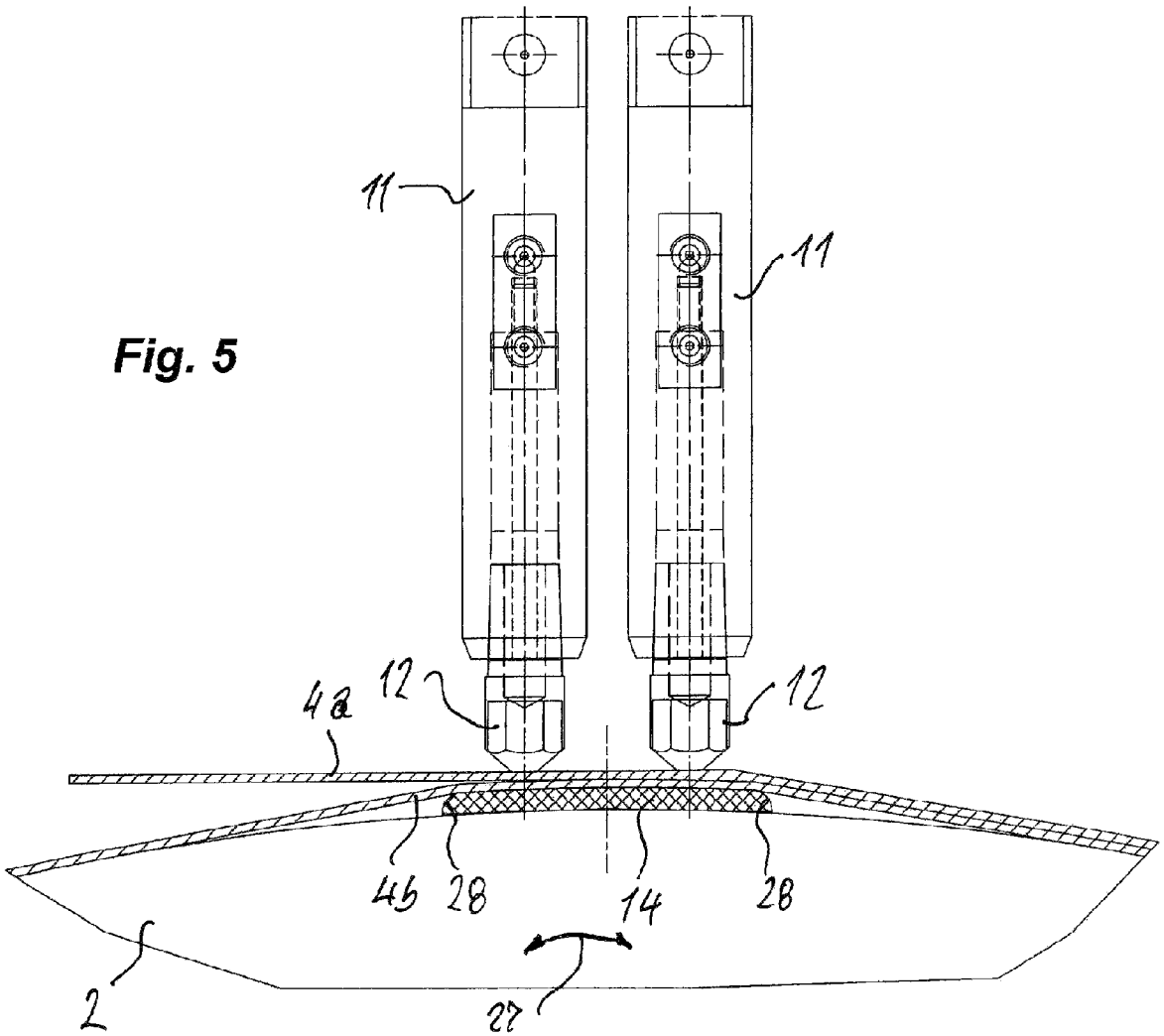
FIG. 5 is a partly sectional schematic view in the welding region of ends of the strapping overlapping one another with a slide plate arranged according to the invention between the strapping and the outer surface of the package as a counter electrode.

As can be seen from FIG. 5, the outer edges of the slide plate 14 in the circumferential direction 27 or, in the case of two slide plates arranged next to one another, the outer edges of the projecting tongues 14*a* (see FIG. 4), have a convex curvature 28 that further promotes the conforming or engagement of the slide plate 14, or 14*a*, 14*b*, which is elastic due to its small thickness, to the outer surface of the package 2.

Figure 6:
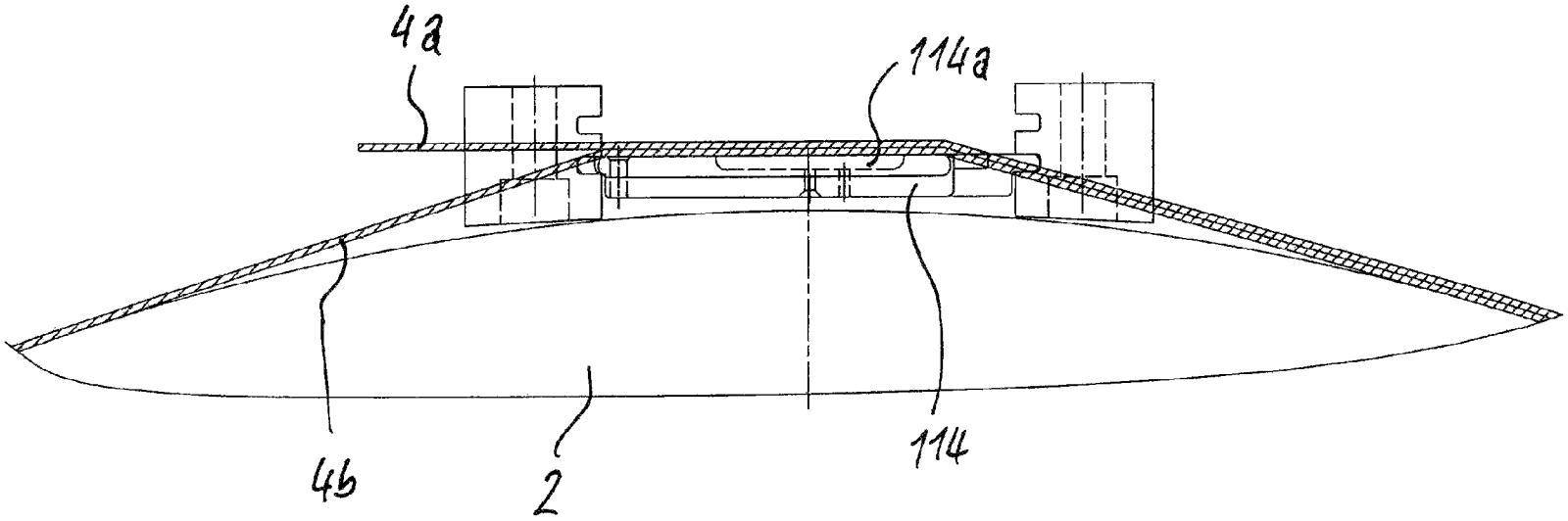
Fig. 6 Prior Art
FIG. 6 shows the welding region as above without welding electrodes according to the prior art.

In a comparison with the known slide plate embodiment shown in FIG. 6, in which the counter electrode 114*a* shown by a dashed line is embedded in the lower steel slider 114 that in turn is guided in grooves of sidewalls, FIG. 5 clarifies the great advantage of the achieved gain in tensile force. According to FIG. 6, considerable slack is required in the strapping because a large spacing must be provided for the steel slider and the sidewall guides thereof, which then leads to a loss of tensile force when the closed loop springs back to rest on the outer surface of the package 2. The additional elongation here can be used completely as tensile force to the largest possible extent according to FIG. 5.

The invention claimed is:

1. A strapping machine for securing at least one strap around a package, the strapping machine comprising:

a binding head engageable against the package, a cincher, and a welder for connecting ends of the tightened strap and having at least one upper advanceable welding electrode in an electrode housing and a counter electrode temporarily interacting therewith, and a slide plate movable toward the package, forming the counter electrode, engaging underneath overlapping ends of the strapping and directly on the package, and having a projecting tongue spaced from the welding electrode and a plate end part connected to a positioning mechanism.

2. The strapping machine according to claim 1, wherein the plate end part carries a cooling block that is formed with coolant passages connectable to a coolant supply.

3. The strapping machine according to claim 1, further comprising:

a support frame carrying the plate end part and provided with an orthogonal vertical guide having a compression spring means in an integrated manner, the positioning mechanism acting on the vertical guide.

4. The strapping machine according to claim 3, wherein a pneumatic cylinder unit forms the positioning mechanism.

5. The strapping machine according to claim 1, wherein the slide plate is formed of copper and at least the projecting tongue is constructed to conform elastically to the surface of the package.

6. The strapping machine according to claim 5, wherein outer edges of the slide plate in the circumferential direction of the package are formed with a curvature.

7. The strapping machine according to claim 1, further comprising:

an end stop projecting downward, bearing against the surface of the package, spaced apart from the projecting tongue in the adjustment direction, and on the housing of the binding head.

8. The strapping machine according to claim 1, further comprising:

a positioning cylinder acting horizontally on the electrode housing.

9. The strapping machine according to claim 1, wherein there are at least two of the binding heads with respective slide plates next to one another.

* * * * *